US008291609B2

(12) United States Patent
Zoucha

(10) Patent No.: US 8,291,609 B2
(45) Date of Patent: Oct. 23, 2012

(54) METHOD AND MEANS FOR DRYING GRAIN IN A STORAGE BIN

(76) Inventor: James Zoucha, Orchard, NE (US)

( * ) Notice: Subject to any disclaimer, the term of this patent is extended or adjusted under 35 U.S.C. 154(b) by 542 days.

(21) Appl. No.: 12/657,126

(22) Filed: Jan. 14, 2010

(65) Prior Publication Data

US 2011/0167666 A1 Jul. 14, 2011

(51) Int. Cl.
*F26B 3/34* (2006.01)

(52) U.S. Cl. ..... 34/267; 34/312; 34/168; 432/14; 95/116

(58) Field of Classification Search ..... 34/264, 34/267, 443, 312, 134, 168, 177, 138, 201; 95/116, 140; 431/247; 432/14
See application file for complete search history.

(56) References Cited

U.S. PATENT DOCUMENTS

| | | | | |
|---|---|---|---|---|
| 2,737,878 | A * | 3/1956 | Maho | 454/180 |
| 4,015,366 | A * | 4/1977 | Hall, III | 47/1.43 |
| 4,750,273 | A | 6/1988 | Parkes et al. | |
| 5,230,160 | A * | 7/1993 | Gross et al. | 34/263 |
| 5,893,217 | A * | 4/1999 | Johanson et al. | 34/266 |
| 6,003,244 | A * | 12/1999 | Johanson et al. | 34/267 |
| 6,223,451 | B1 * | 5/2001 | Satake et al. | 34/134 |
| 6,834,443 | B2 | 12/2004 | Bloemendaal | |
| 2003/0150128 | A1 * | 8/2003 | Macaluso et al. | 34/397 |
| 2008/0134539 | A1 * | 6/2008 | Prokhorets et al. | 34/312 |
| 2011/0167667 | A1 * | 7/2011 | Zoucha | 34/267 |
| 2012/0066924 | A1 * | 3/2012 | Ando et al. | 34/90 |
| 2012/0090193 | A1 * | 4/2012 | Wefers | 34/418 |

* cited by examiner

*Primary Examiner* — Stephen M. Gravini
(74) *Attorney, Agent, or Firm* — Dennis L. Thomte; Thomte Patent Law Office LLC

(57) ABSTRACT

An apparatus is disclosed for drying grain in a storage bin as well as the method of drying the grain. The apparatus includes an air blower positioned outwardly of the storage bin which has an air inlet end and an air discharge end. The air discharge end of the air blower is in communication with the interior of the storage bin. A heat exchanger is positioned in a spaced relationship with respect to the air blower and has an air passageway with an inlet end and an outlet end. The outlet end of the heat exchanger is spaced from the inlet end of the air blower. An infrared heater is spaced from the inlet end of the heat exchanger so that infrared rays from the infrared heater will be directed into the air passageway of the heat exchanger so that the heat exchanger will heat the air being drawn through the heat exchanger by the air blower with the air blower sucking heated air from the air passageway and blowing the same into the storage bin to dry the grain therein.

15 Claims, 6 Drawing Sheets

METHOD AND MEANS FOR DRYING GRAIN IN A STORAGE BIN

BACKGROUND OF THE INVENTION

1. Field of the Invention

This invention relates to an apparatus for drying grain in a storage bin as well as the method of drying the grain. More particularly, the apparatus of this invention includes an infrared heater which heats components of a heat exchanger spaced from the infrared heater with the heat exchanger being in communication with the inlet end of an air blower. The discharge end of the air blower is in communication with the interior of the storage bin. Even more particularly, the apparatus of this invention heats the air passing through the heat exchanger by the air passing over the heated components of the heat exchanger. The heated air is then blown into the interior of the storage bin by the air blower to dry the grain therein.

2. Description of the Related Art

Many devices have been previously provided for drying grain contained within a storage bin. Normally, the prior art devices include a gas burner for heating air which is blown into the interior of the storage bin by an air blower which may be either an axial blower or a centrifugal blower. The prior art gas burners usually are fueled by propane which is extremely expensive.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An apparatus is described for drying grain in a storage bin. A conventional air blower is provided which has an air inlet end and an air discharge end with the air discharge end of the air blower being in communication with the interior of the storage bin in conventional fashion. A heat exchanger is also provided which has an air passageway with an inlet end and an outlet end. The outlet end of the heat exchanger is spaced from the inlet end of the air blower. The apparatus also includes an infrared heater spaced from the inlet end of the heat exchanger whereby infrared rays from the infrared heater are directed into the air passageway of the heat exchanger to heat internal components within the heat exchanger so that air being drawn through the air passageway by the air blower will be heated as the air passes over the heated internal components of the heat exchanger. The air blower sucks the heated air from the air passageway and heats the heated air into the storage bin to dry the grain therein.

The internal components of the heat exchanger include a plurality of spaced-apart vanes which are preferably coated with a high-temperature dark paint to enhance the absorption of the rays from the heater so that the vanes are heated. In the preferred embodiment, a shroud surrounds the heat exchanger between the inlet and outlet ends thereof which is spaced from the heat exchanger.

The method of drying the grain is also disclosed.

It is therefore a principal object of the invention to provide an improved apparatus for drying grain in a storage bin.

A further object of the invention is to provide an improved method for drying grain in a storage bin.

A further object of the invention is to provide an apparatus for drying grain in a storage bin with the apparatus including an infrared heater.

A further object of the invention is to provide an apparatus of the type described wherein the infrared heater is fueled by diesel fuel.

A further object of the invention to provide a means for drying grain in a storage bin which is extremely efficient and which is more economical than the methods of the prior art.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
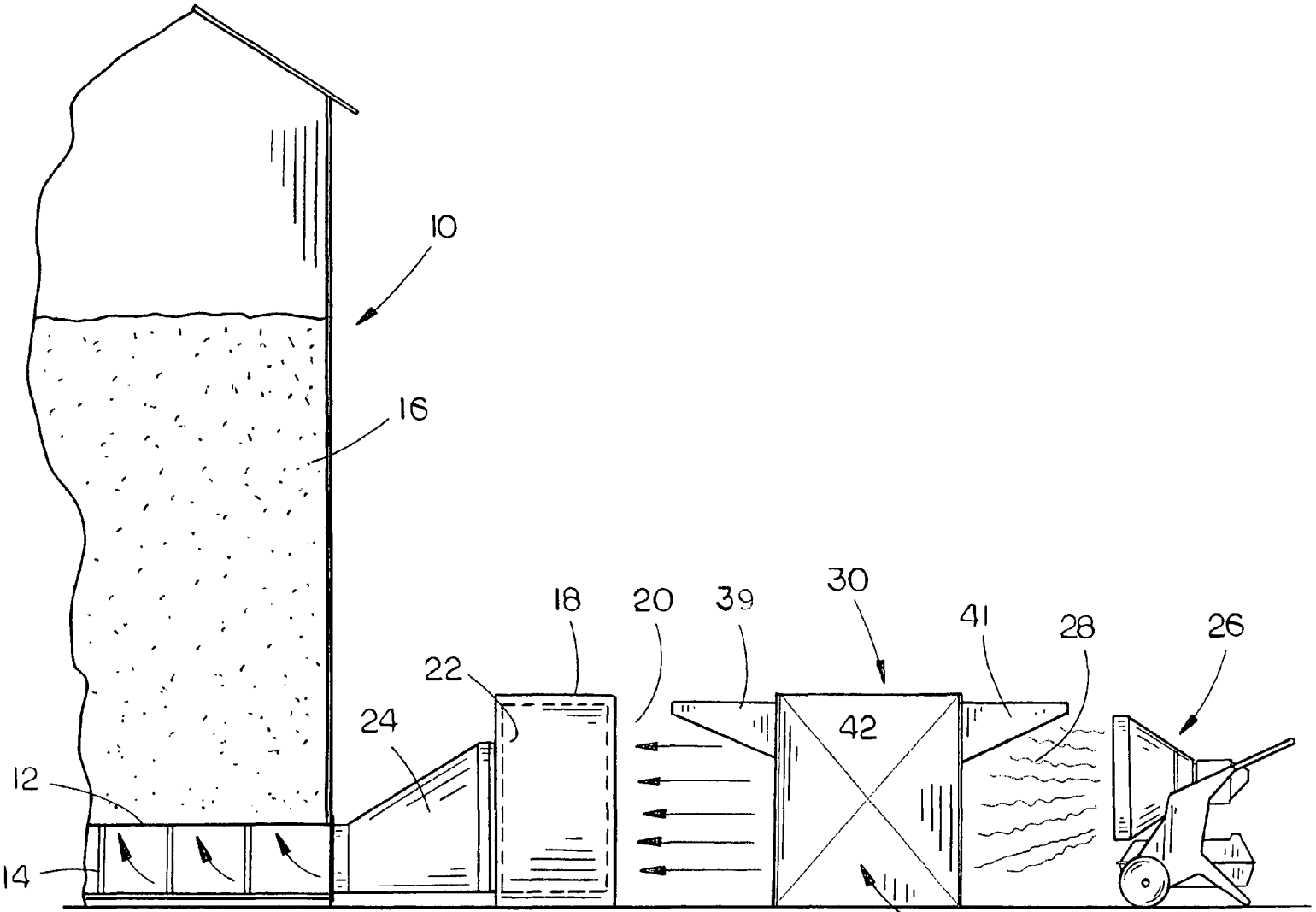
FIG. 1 is a side view illustrating the means of this invention for drying grain in a storage bin.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

In the drawings, the numeral 10 refers to a conventional storage bin which has a perforated floor 12 spaced above the lower end thereof with a plenum 14 being provided beneath the floor 12. Normally, the storage bin 10 will have a pair of air outlets positioned in the roof thereof and will have a conventional selectively closable center opening formed therein at the peak of the roof. The numeral 16 refers to grain contained within the storage bin.

A conventional air blower or fan 18 is provided which has an air inlet end 20 and an air discharge end 22 which is in communication with a transition housing or shroud 24 which extends to the plenum 14 so that when the blower 18 is activated, air will be blown into the plenum 14 and upwardly through the perforated floor 12 into the grain and then pass outwardly from the bin 10 by way of the outlets and central opening in the roof of the bin 10. The blower 18 may be either an axial flow blower or a centrifugal blower.

Figure 3:
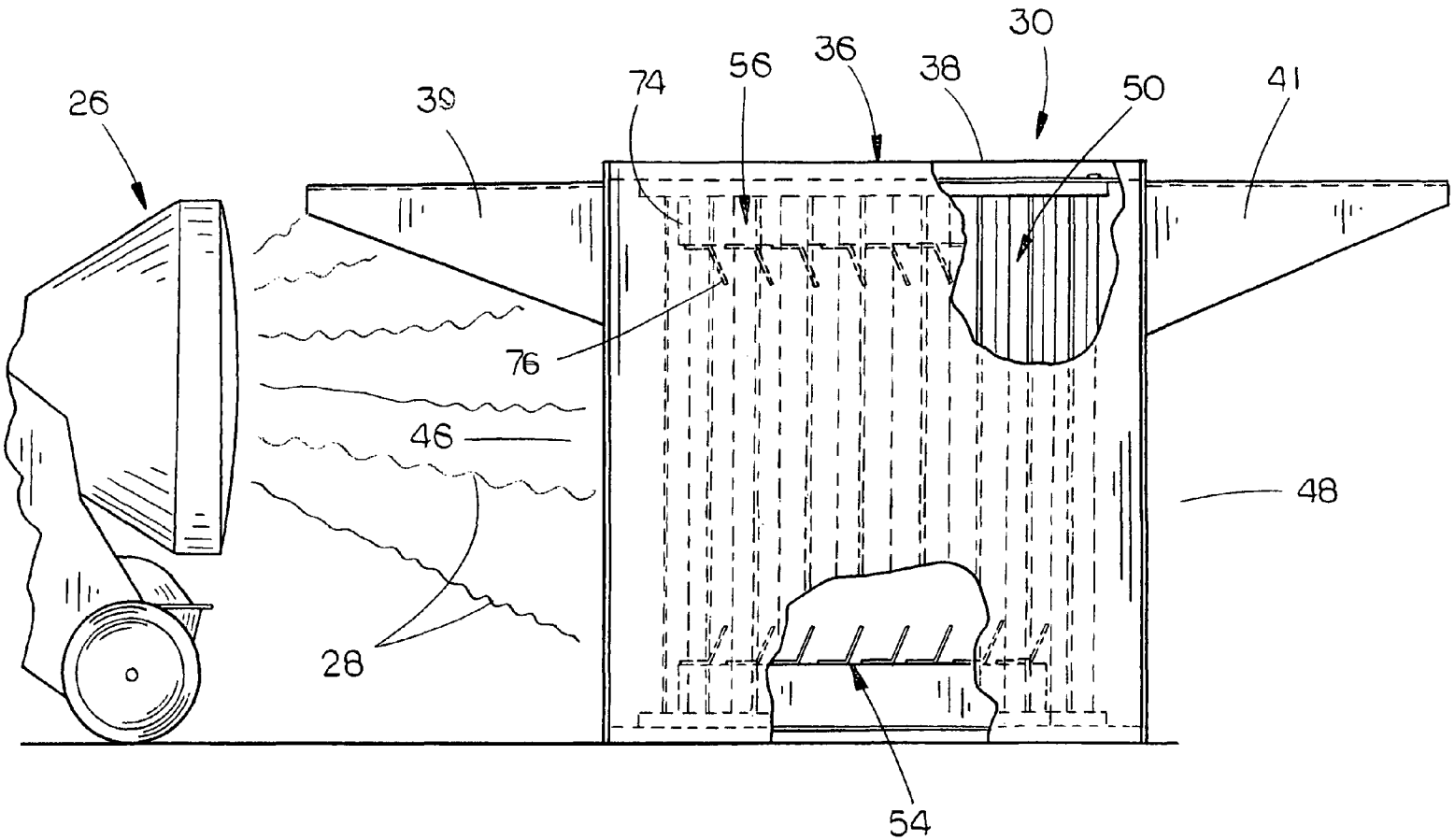
FIG. 3 is a side elevational view of the infrared heater and the heat exchanger with portions thereof cut away to more fully illustrate the invention.
Figure 4:
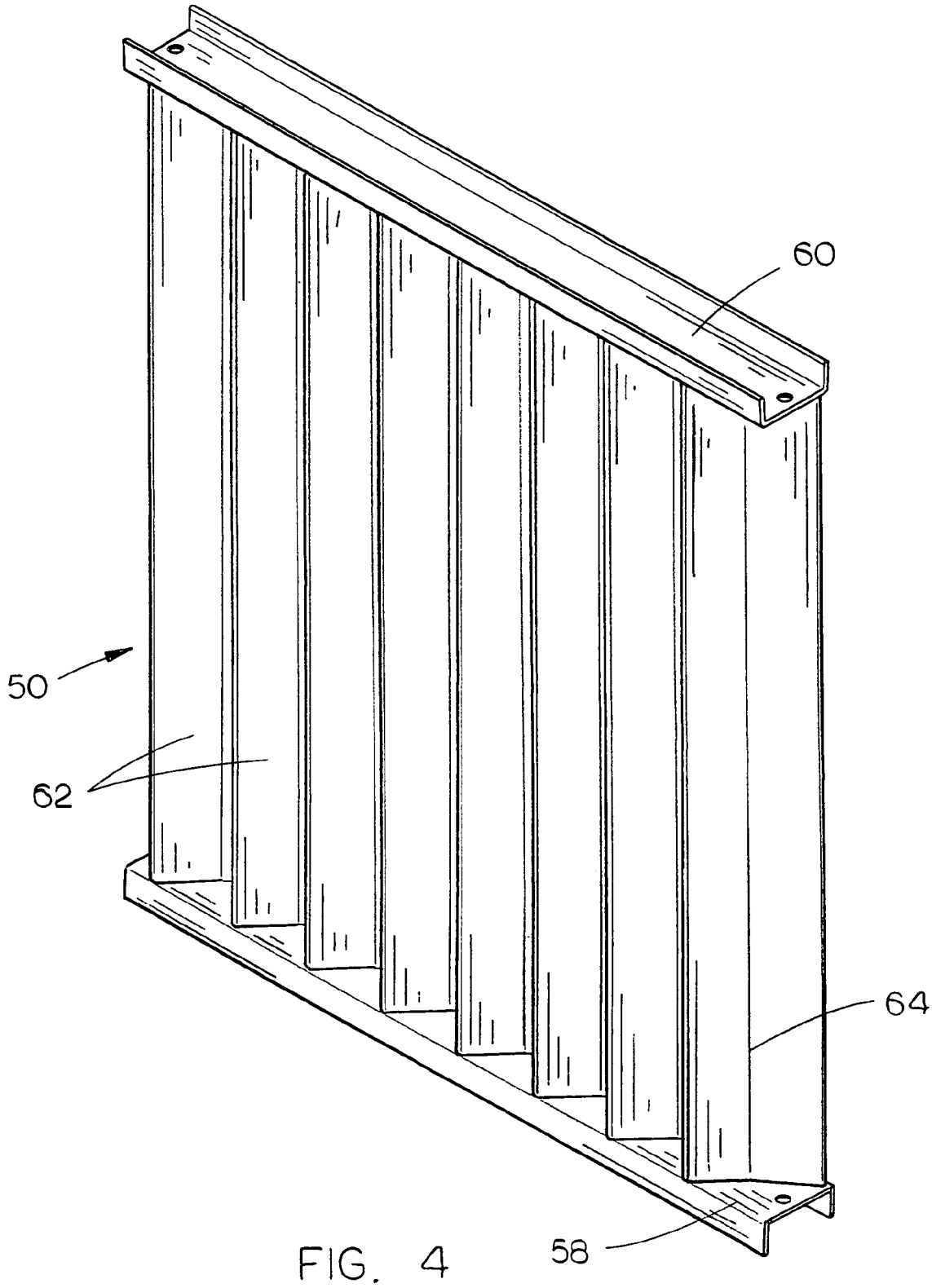
FIG. 4 is a perspective view of one of the heat exchanger assemblies within the heat exchanger.
Figure 5:
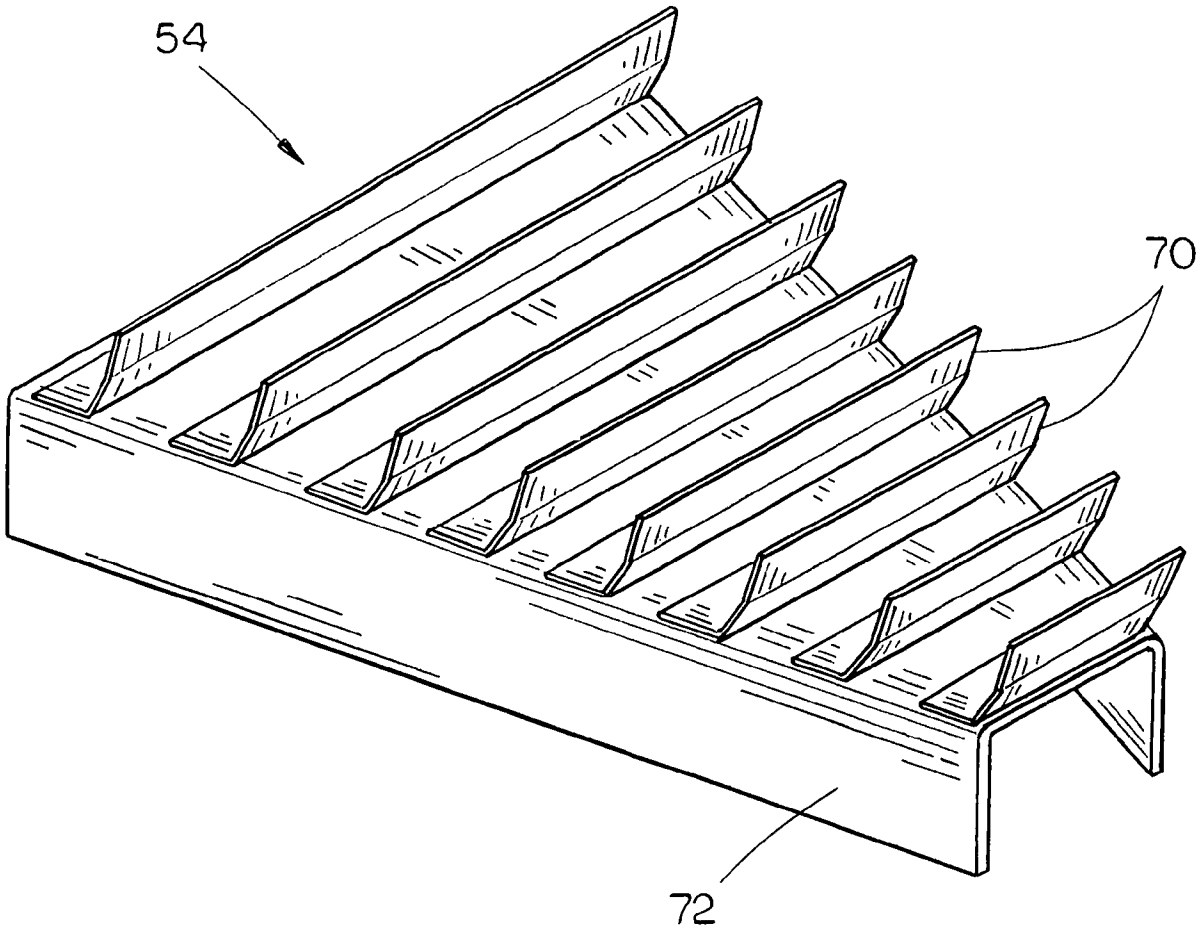
FIG. 5 is perspective view of one of the heat exchanger assemblies in the heat exchanger.
Figure 6:
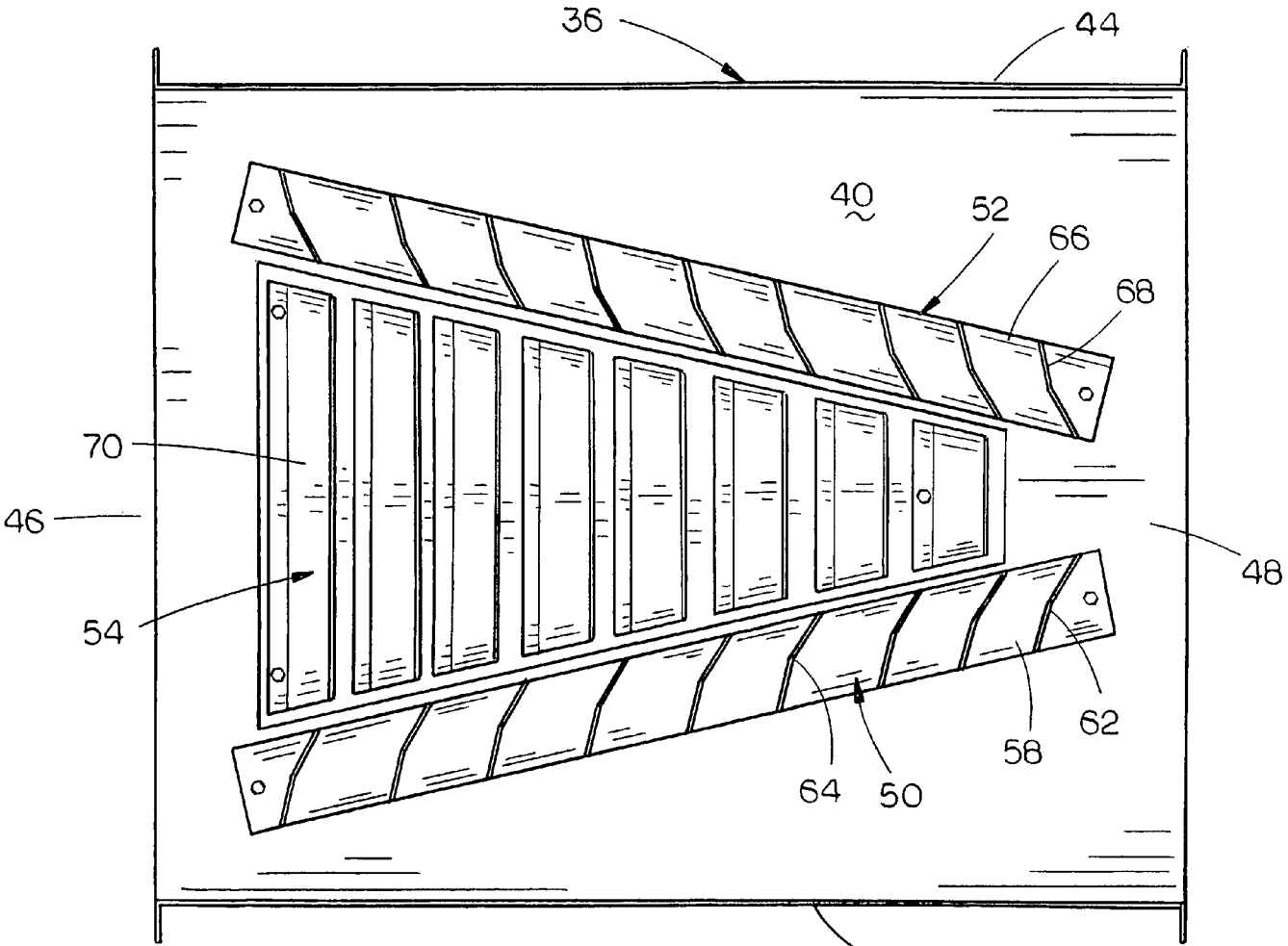
FIG. 6 is a top view of a portion of the heat exchanger assembly with the upper heat exchanger being not shown for purposes of clarity.

The numeral 26 refers to an infrared heater such as the Val6 Series heater manufactured and sold by Shizuoka Seiki Co., Ltd., having an address of 4-1 Yamana, Fukuroi-shi, Shizuoka-ken, Japan. The infrared heater 26 is diesel fuel fired and emits infrared rays 28 therefrom as illustrated in FIGS. 1 and 3 in conventional fashion when the heater is energized.

The numeral 30 refers to the heat exchanger of this invention which enables the heater 26 to be used in conjunction with the air blower 28 so as to provide heated air to be furnished to the inlet end of the air blower 18 so that the air blower 18 may blow the heated air into the plenum 14 and into the grain 16 through the perforated floor 12 as will be described in greater detail hereinafter.

Figure 2:
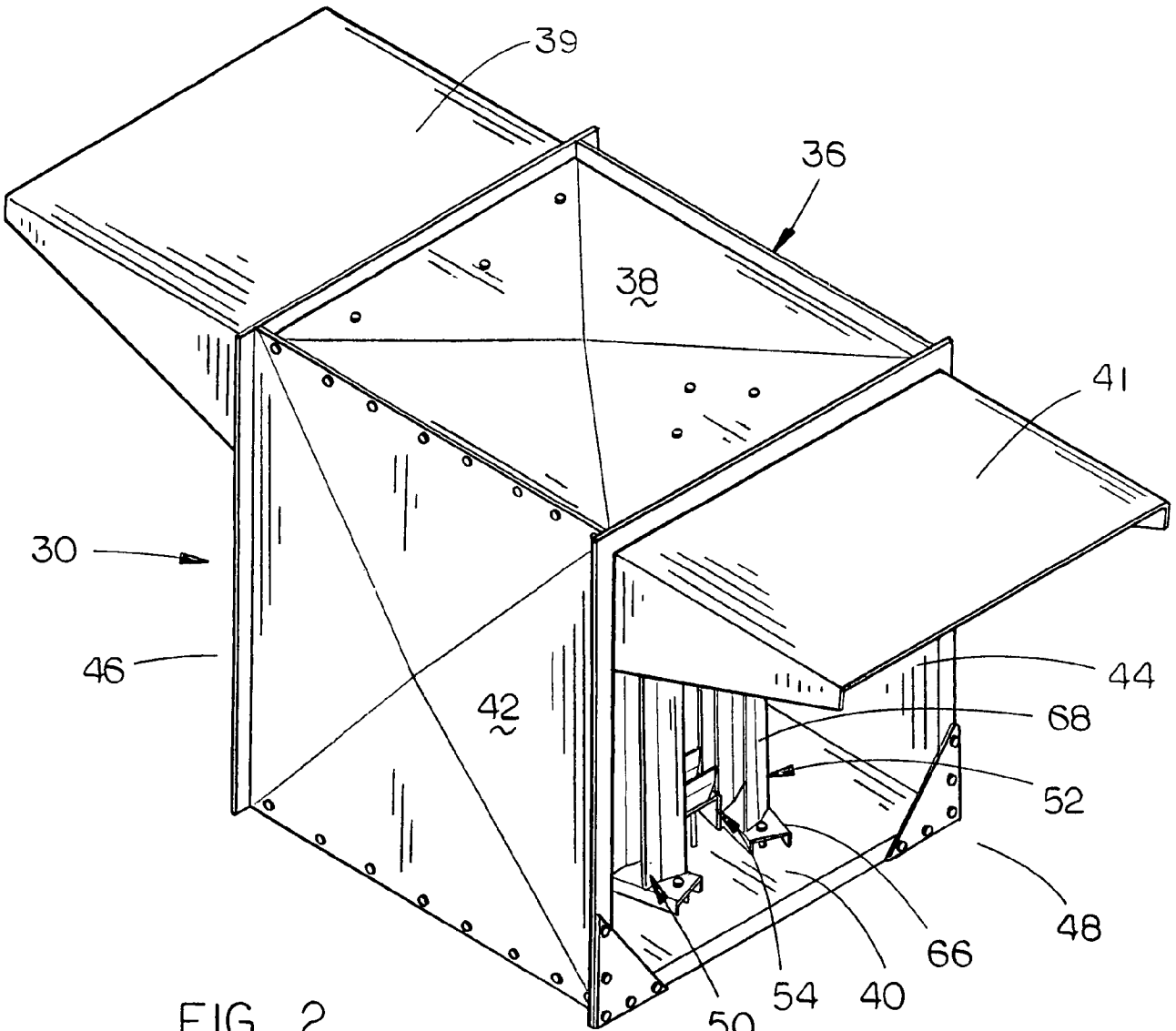
FIG. 2 is a rear perspective view of the heat exchanger portion of this invention.

Heat exchanger 30 includes an outer shroud or housing 36 which extends around the internal components of the heat exchanger 30 and which includes a top wall 38, a bottom wall 40, and opposite side walls 42 and 44. For purposes of description, shroud 36 will be described as having an air inlet end 46 and an air discharge end 48. Deflectors 39 and 41 extend rearwardly and forwardly, respectively, from the upper end of shroud 36 as seen in FIGS. 1 and 2.

Heat exchanger 30 includes a first heat exchanger assembly 50, a second heat exchanger assembly 52, a third heat exchanger assembly 54 and a fourth heat exchanger assembly 56. Assembly 50 includes a lower channel member or support 58 which is secured to bottom wall 40 of shroud 36 by any convenient means and which extends inwardly and rearwardly from its forward end to its rearward end. Assembly 50 also includes an upper channel member or support 60 which is secured to top wall 38 of shroud 36 by any convenient means and which extends inwardly and rearwardly from its forward end to its rearward end in the same vertical plane as channel member 58. A plurality of spaced-apart and vertically disposed vanes, blades or fins 62 are secured to supports 58 and 60 and extend therebetween at an angle with respect to the supports 58 and 60 and with respect to the longitudinal axis of the shroud 36. It is preferred that each of the vanes 62 are somewhat angular by being bent at 64 to enhance airflow therearound.

Assembly 52 is a mirror image of assembly 50 and includes a lower channel member or support 66 which is secured to bottom wall 40 of shroud 36 and which extends inwardly and rearwardly from its forward end to its rearward end. An upper channel member or support (not shown) is secured to top wall 38 of shroud 36 and which extends rearwardly and inwardly from its forward end to its rearward end directly above channel 66. A plurality of spaced-apart vanes, blades or fins 68 are secured to channel 66 and the channel thereabove and extends therebetween at an angle with respect to the longitudinal axis of the channels and at an angle with respect to the longitudinal axis of the shroud 36. It is preferred that each of the vanes, blades or fins 62 are also bent somewhat to enhance the airflow therearound in the same fashion as vanes 62.

The third heat exchanger assembly 54 includes a channel-like support 72 which has a rearward end which has a greater width than its forward end. The rearward end of the support 72 extends between the rearward ends of the lower channels 58 and 64 and is secured to bottom wall 40 of shroud 36 by any convenient means. A pair of transversely extending and horizontally spaced-apart vanes, blades or fins 70 are secured to the upper surface of support 72 by any convenient means such as by welding or the like. As seen in the drawings, the length of the vanes 70 progressively decrease from the rearward end of the assembly 54 to the forward end of the assembly 54. Preferably, each of the vanes 70 have a slight curvature as illustrated in the drawings to enhance airflow therearound.

Heat exchanger assembly 56 is a mirror image of heat exchanger assembly 54 and includes a channel-like support 74 which extends forwardly from its rearward end to its forward end between the upper ends of assemblies 50 and 52. The width of the support 74 is greater at its rearward end than at its forward end. A plurality of vanes 76 are secured to the support 74 by any convenient means such as by welding or the like and extend downwardly therefrom. As seen in the drawings, the length of the vanes 76 decreases from the rearward end of the heat exchanger 56 to the forward end thereof. As also seen, the vanes 76 have a slight curvature.

The vanes 62, 68, 70 and 76 are preferably coated with a high temperature dark colored paint to increase the heat absorption of the vanes. The heat exchanger assemblies 50, 52, 54 and 56 define an air passageway therebetween. The spacing of the shroud 36 from the heat exchanger assemblies creates an insulation space therebetween to prevent heat loss from the heat exchanger assembly.

As seen in the drawings, the discharge side of the heater 28 is spaced from the inlet end of the shroud 36 of heat exchanger 30. The infrared rays from the heater 30 are directed into the inlet end of the shroud 36 with the vanes 62, 68, 70 and 76 being radiantly heated by the infrared rays 28 from the infrared heater 30. When blower 32 is actuated, blower 18 draws or sucks air into the inlet end of the shroud 36 onto the vanes 62, 68, 70 and 76 of the heat exchanger assemblies 50, 52, 54 and 56 respectively with the same being radiantly heated. As the air is being sucked through the passageway between the assemblies 50, 52, 54 and 56 by the blower 18, the air is passed over the vanes and is deflected inwardly by the heat exchanger assemblies 50 and 52, is deflected upwardly by the heat exchanger assembly 54, and is deflected downwardly by the heat exchanger assembly 56. As the air passes over the vanes, the air is heated by those heated vanes and is sucked from the discharge end of the heat exchanger 30 into the blower 18 and then into the interior of the storage bin and into the grain to dry the same.

The use of a diesel fired infrared heater 26 greatly decreases the cost of drying the grain since the infrared heater 26 is highly efficient and is able to burn diesel fuel which is less expensive than propane and which is more efficient.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. An apparatus for drying grain in a storage bin, comprising:

an air blower having an air inlet end and an air discharge end;

said air discharge end of said air blower being in communication with the interior of the storage bin;

a heat exchanger having an air passageway extending therethrough with an inlet end and an outlet end;

said outlet end of said heat exchanger being spaced from said inlet end of said air blower;

and an infrared heater spaced from said inlet end of said heat exchanger whereby infrared rays from said infrared heater will be directed into said air passageway of said heat exchanger so that said heat exchanger will be heated by said infrared rays to heat the air being drawn through said heat exchanger by said air blower;

said air blower sucking heated air from said air passageway and blowing the same into said storage bin to dry the grain therein.

2. The apparatus of claim 1 wherein said heat exchanger includes a shroud which extends around heated components of said heat exchanger.

3. The apparatus of claim 2 wherein said shroud is spaced from the internal heated components of said heat exchanger.

4. The apparatus of claim 1 wherein said infrared heater is oil fired.

5. The apparatus of claim 1 wherein said infrared heater is diesel oil fired.

6. The apparatus of claim 1 wherein said heat exchanger has a plurality of spaced-apart vanes provided thereon which are heated by the infrared rays passing into said heat exchanger.

7. The apparatus of claim 3 wherein said heat exchanger has a plurality of spaced-apart vanes provided therein which are heated by the infrared rays passing into said heat exchanger.

8. The apparatus of claim 6 wherein said vanes are angularly disposed so as to deflect the air passing through said air passageway.

9. The apparatus of claim 2 wherein said heat exchanger has a plurality of spaced-apart vanes provided thereon which are heated by the infrared rays passing into said heat exchanger.

10. The apparatus of claim 9 wherein said vanes are angularly disposed and spaced-apart so as to deflect the air passing through said air passageway.

11. The apparatus of claim 6 wherein said vanes are coated with a dark colored paint to enhance the heat absorption of the vanes.

12. The method of drying grain in a storage bin, comprising the steps of:

providing an air blower having an air inlet end and an air discharge end;

positioning the air blower so that its air discharge end is in communication with the interior of the storage bin;

providing a heat exchanger having an open air inlet opening and an open air discharge end;

positioning the heat exchanger so that its air discharge end is spaced from the air inlet opening of the air blower;

providing an infrared heater having an infrared ray discharge side;

positioning the infrared heater so that its ray discharge side is spaced from the air inlet opening of the heat exchanger;

operating the infrared heater so that at least some of the infrared rays produced thereby are directed into the air inlet opening of the heat exchanger and into the interior of the heat exchanger to heat internal components of the heat exchanger; and operating the air blower so that ambient air is drawn into the heat exchanger by way of the air inlet end thereof and drawn outwardly from the air discharge end of the heat exchanger with the air passing through the heat exchanger being heated by its contact with the heated internal components of the heat exchanger and so that the heated air is drawn into the air blower and blown into the storage bin for contact with the grain therein to dry the same.

13. The method of claim 12 wherein an insulating shroud is positioned around at least a portion of the internal components of the heat exchanger and which is spaced therefrom.

14. The method of claim 12 wherein the heat exchanger has a plurality of spaced-apart vanes provided therein which are heated by the infrared rays entering the heat exchanger.

15. The method of claim 14 further including the step of coating the vanes with a high temperature dark colored paint material.

* * * * *